United States Patent [19]

Yan

[11] 4,346,936

[45] Aug. 31, 1982

[54] TREATMENT OF SUBTERRANEAN URANIUM-BEARING FORMATIONS

[75] Inventor: Tsoung-Yuan Yan, Philadelphia, Pa.

[73] Assignee: Mobil Oil Corporation, New York, N.Y.

[21] Appl. No.: 179,549

[22] Filed: Aug. 19, 1980

[51] Int. Cl.[3] ..... E21B 43/28

[52] U.S. Cl. ..... 299/4; 423/17; 423/18

[58] Field of Search ..... 299/4, 5; 423/17, 18

[56] References Cited

U.S. PATENT DOCUMENTS

| | | | |
|---|---|---|---|
| 2,964,380 | 12/1960 | Kolodney et al. | 299/5 X |
| 3,130,960 | 4/1964 | Martin | 299/5 |
| 3,278,233 | 10/1966 | Hurd et al. | 299/4 |
| 3,708,206 | 1/1973 | Hard et al. | 299/5 |
| 3,713,698 | 1/1973 | Rhoades | 299/4 |
| 4,083,603 | 4/1978 | Stover | 299/4 |
| 4,105,253 | 8/1978 | Showalter | 299/5 X |
| 4,113,313 | 9/1978 | Terry | 299/4 |

*Primary Examiner*—Stephen J. Novosad

*Attorney, Agent, or Firm*—Charles A. Huggett; James F. Powers, Jr.; John K. AboKhair

[57] ABSTRACT

A process is described for improving yields and leaching rates of mineral values in highly reducing uranium-bearing formations, while minimizing deleterious environmental impact, by injecting an oxidant such as gaseous air or $O_2$ into the formation prior to leaching. The preoxidation may be enhanced by the presence of $CO_2$ gas in the pre-leaching oxidant. The process is particularly suitable for systems employing a $CO_2/O_2$ lixiviant. The presence of sulfate ion further improves the leaching rate of such a system.

11 Claims, No Drawings

TREATMENT OF SUBTERRANEAN URANIUM-BEARING FORMATIONS

FIELD OF THE INVENTION

This invention relates generally to the in situ leaching of mineral values, in particular uranium, from subterranean formations. More specifically, this invention provides processes for the treatment of highly reducing uranium-bearing formations to improve yields and leaching rates while minimizing deleterious environmental impact such as groundwater and air pollution.

BACKGROUND OF THE INVENTION

The $CO_2/O_2$ leaching system has already been used commercially for in situ leaching at sites in South Texas. The chemistry of this system is described in detail in the literature. In essence a $CO_2/CO_2$-containing leaching solution, or lixiviant, is pumped through the formation to solubilize insoluble tetravalent uranium in the formation to soluble hexavalent uranium and to remove this dissolved uranium in the pregnant lixiviant from the formation through the production wells. The earlier processes used chlorate ions or hydrogen peroxide to oxide the uranium in the formation:

$$3UO_2(S)+ClO_3^-+3H_2O\rightarrow 3UO_2^{+2}(S)+Cl^-+6OH^-$$

$$UO_2(S)+H_2O_2\rightarrow UO_2^{+2}(S)+2OH^-$$

When oxygen dissolved in the lixiviant is used as the oxidant, the reaction essentially follows the overall reaction applicable to any oxidation of tetravalent to hexavalent uranium:

$$UO_2(S)+[O]+H_2O\rightarrow UO_2^{+2}(S)+2OH^-$$

This hexavalent uranium is dissolved in the lixiviant by the formation of a soluble uranyl carbonate complex:

$$UO_2^{+2}(S)+3CO_3^{=}\rightarrow UO_2(CO_3)_3^{-4}3HCO_3^-\rightarrow 3CO_3^{=}+3H^+$$

The overall $CO_2/O_2$ leach reaction, therefore, may be given as:

$$UO_2(S)+[O]+3HCO_3^-\rightarrow UO_2(CO_3)_3^{-4}+H^+$$

This leaching process has the obvious advantage of avoiding the use of ammonium ions, as in the ammonium carbonate/bicarbonate process, wherein ammonium ions may be exchanged onto the sodium and calcium smectite clays found in the South Texas uranium-bearing formations, creating a possible threat of groundwater contamination. This $CO_2/O_2$ leaching system works well in formations wherein oxidant consumption is moderate.

However, it has been found that many uranium formations contain large amounts of reducing compounds, such as $H_2S$ and other sulfides, hydrocarbon gases and other organic matter, which act as oxygen scavengers. For example, many of the roll-type formations which are notably suitable for in situ uranium leaching contain $MoS_2$ and $FeS_2$ as well. These compounds, as well as the other sulfides and organic compounds referred to above, preferentially consume the oxygen available in the injected lixiviant, effectively inhibiting the solubilizing of uranium until most or all of these scavengers are oxidized. The side reaction with molybdenite, $MoS_2$, poses yellowcake contamination problems as well as producing acid as it consumes oxidants:

$$MoS_2(S)+9[O]+3H_2O\rightarrow MoO_4^{-2}+6H^++2SO_4^{=}$$

In many formations this scavenging or reducing capacity is so high that the leaching rate is limited by the supply of oxidants. This is particularly true where the $CO_2/O_2$ leaching system is used because the solubility of $O_2$ in the leaching solution is low; the scavenging of the $O_2$ supply is most marked at early stages of the leaching operation. In the typical in situ leaching operation, where the lixiviant, or leach solution, is injected into one well and the pregnant lixiviant, or leachate, is produced from other wells spaced at a distance, no uranium will be produced in the pregnant lixiviant until the entire formation is essentially oxidized.

SUMMARY AND DETAILED DESCRIPTION OF THE INVENTION

In order to overcome the disadvantages of $CO_2/O_2$ leaching disclosed above, and in order to provide an in situ leaching process which produces leachate of higher uranium concentration than that previously available, I have invented a process which is versatile and which produces surprising increases in yield. The invention disclosed and claimed herein provides an effective means to introduce an oxidant to the formation to oxidize the scavenging compounds in the formation prior to the leaching operation itself. This process is also adapted to treatments of the formation during the course of the leaching operation itself in order to improve yields that may have fallen off as the formation leaching rate decreases.

In accordance with this invention, prior to leaching, oxidant is pumped into the formation. The preferred oxidants are air and $O_2$, which are injected into the formation as gases. After some $O_2$ has broken through and is produced at the production wells, the production wells are shut in for a period of time so that the $O_2$ gas trapped in the formation can oxidize the reducing compounds. The gas composition at the production well heads and the Eh of the produced water may be monitored to determine whether, and at what rate, the oxygen introduced in gaseous form to the formation has been exhausted. If the injected oxygen has been exhausted by reaction with the scavenging compounds in the formation, additional oxidant may be pumped into the formation and the production wells shut in in repeated steps until the formation is sufficiently oxidized. To help the distribution of $O_2$ gas in the formation, the $O_2$ or air and the water used to distribute the gas may be injected into the formation in the form of slugs in alternation. During the preleaching oxidation period, no uranium will be produced, minimizing the production of water from the production wells. Once the oxidation pretreatment has been completed, the usual $CO_2/O_2$ leaching process may be carried out.

While the foregoing pre-leaching treatment supplies oxygen to the formation at the least cost, and allows for the least amount of water to be circulated in the leaching circuit, it has been additionally found that this preoxidation is greatly enhanced by the presence of $CO_2$ gas in the $O_2$ gas or air used as the pre-leaching oxidant. The $CO_2/O_2$ mixture is pumped in as gases, with the preferred molar ratio of the $CO_2/O_2$ gas mixture being from about 0.001:1 to 100:1, depending upon the nature of the formation. The proper molar ratio can be calculated on the basis of core samplings of the formation to be leached. Otherwise, the process is the same as that set forth above.

This $CO_2/O_2$ gas mixture may also be used to stimulate in situ uranium leaching from already partially leached ores. In one experiment conducted in the laboratory using core samples from a South Texas uranium field, it was found that the $U_3O_8$ concentration in the leachate jumped from 160 to 1060 ppm when the ore was treated with a $CO_2/O_2$ gas mixture; approximately 40% of the uranium had been leached from the core prior to the treatment. In accordance with this refinement of the invention disclosed and claimed herein, the leached solution is stopped after the leaching rate has declined to a predetermined level, and a mixture of $CO_2$ and $O_2$ is injected into the formation. As above, the preferred molar ratio of $CO_2$:$O_2$ is from about 0.001:1 to 100:1, depending upon the nature of the formation. The rate of gas injection should be controlled to minimize the excursion of fluid already in the formation beyond the monitoring wells. Once the $O_2$ has broken through and has been produced at the production well, the wells are shut in to allow the $CO_2/O_2$ mixture to react with the formation, which includes uranium. This period of shutting in may be as long as one day to one month or longer. If additional $CO_2/O_2$ mixture is required, the above steps should be repeated. After this treatment, the regular leaching may be restarted.

The use of the $CO_2/O_2$ gas mixture disclosed herein has the additional advantage of affording significant recovery of uranium from refractory ores, increasing both the leaching rate and the level of uranium recovery. The dissolution of high pressure $CO_2$ into the lixiviant has heretofore been too costly due to excess $CO_2$ consumption. The process according to this invention allows the formation to be saturated with $CO_2/O_2$ gas at high pressures with little $CO_2$ consumption connected with the flushing and production of leachate from the production wells, and thus achieves the benefits of high pressure $CO_2$ operation at considerably less cost. As with the refinements of this process using the $CO_2/O_2$ gas mixture disclosed above, the production wells in the refractory ore fields are shut in to allow the reactions between $CO_2/O_2$ and the formation to take place. If the $O_2$ in the gas mixture is depleted or exhausted during the shut in period, more mixture should be injected. In these repeated injections, the composition of the $CO_2/O_2$ mixture can be varied to optimize consumption of the mixture. Ordinarily, it would be expected that the $CO_2/O_2$ ratio should decrease successively with each additional injection required.

The preoxidation of uranium-bearing ore bodies with $O_2$ or $CO_2/O_2$ gas mixture has been found to be advantageous even where the uranium values are not extracted by in situ leaching. For example, there are uranium ore bodies which are located above the aquifer, making the body difficult to exploit by in situ leaching because of high loss of leach solution. These bodies are too difficult to mine because they are too deep for open pit mining and of too low a grade to justify shaft mining. In order to recover the uranium values from these ore bodies, borehole slurry mining is employed. In this process, a well is drilled into the ore body and a water jet is used to pump the ore out of the body in the form of a slurry. Upon draining the water from the slurry for reinjection into the ore body, the ore is piled up as a heap and the uranium values are recovered by heap leaching. Conventional heap leaching processes are discussed in detail in R. C. Merritt, *The Extractive Metallurgy of Uranium,* 112–19 (1971), wherein leaching period of weeks to months are disclosed. As a general matter, $O_2$ is not a suitable lixiviant for heap leaching because of its low solubility (40 ppm) in the lixiviant at 1 atm.

The wells to be employed are drilled in a pattern with spacing appropriate for borehole slurry mining; these wells may be used as either injectors, producers, or both. A mixture of $CO_2$ and $O_2$, wherein the ratio of $CO_2$:$O_2$ is between about 0.01:1 to 10:1, is injected into the formation. As soon as communication is established between the producing wells and the injecting wells, the production wells are shut in for a period typically about 1 to 20 weeks, depending upon the reactivity of the ore. When the pressure at the production well drops to a low level due to near exhaustion of $O_2$ in oxidizing the formation, more of the $CO_2/O_2$ mixture should be injected so as to insure high levels of, or complete, uranium oxidation. It is preferable to improve the distribution of $CO_2/O_2$ in the formation by alternating use of the wells as injectors and producers from one injection to the next successively. Once the formation has been oxidized to the desired extent, water or leach solution should be injected to initiate borehole slurry mining. The water should contain carbonates as a complexing agent so that while the water is injected into the borehole for lifting up the ore, it also complexes and dissolves the uranium value. If the content of carbonate minerals in the ore is low, dilute sulfuric acid may be used in lieu of carbonate solution. The carbonate concentration in the water should be greater than about 300 ppm. This level of carbonation can be obtained by saturating the injection water as it recycles with $CO_2$ to the desired level by varying the $CO_2$ partial pressure. Alkali metal or ammonium carbonates may also be added to increase the pH of the solution, which, while not an important factor from the standpoint of leaching chemistry, should be controlled at a point below pH 8 to avoid excessive sliming. If sulfuric acid is used, the pH of the resulting solution should be controlled at pH 4.5 or lower Of course, additional conventional oxidants such as $O_2$, hydrogen peroxide, sodium chlorate and the like may be added to the injection fluid. The slurry produced from the ore body is allowed to separate by settling and the uranium value is recovered by ion exchange or solvent extraction. The barren solution remaining after uranium value extraction is made up with carbonates or $CO_2$ and recycled for injection into the borehole. The barren solid may be disposed of by refilling the cavern created in the borehole slurry mining or by other conventional techniques.

In addition to the foregoing, the leaching rate of the $CO_2/O_2$ leaching system can be enhanced further by the introduction of sulfate ions into the system. The sulfate ion may be introduced into the $CO_2/O_2$ system at the start of leaching and recycled for use during the whole of the leaching operation period without the further addition of $SO_4^{=}$. In some ore bodies which are rich in $FeS_2$ and other sulfur compounds, the sulfate ion will be produced as a by-product of oxidation of the formation. This excess quantity of sulfate ions must be disposed of to control the sulfate ion concentration at or near the optimum levels. The optimum sulfate ion level must be determined by observation, within the range of 0.1 to 20 percent by weight, based on the leaching solution. The additional treatment of the leaching circuit with sulfate ions is particularly useful in circuits operating at or near neutral pH, i.e., in the range of about 5 to about 9.

The table set forth below reports data showing a two-fold enhancement of leaching rate produced by the addition of sulfate ion to a high pressure $CO_2/O_2$ leaching circuit.

| Column No. | 48 | 50* | 57 | 54 |
|---|---|---|---|---|
| Ore | | 4U-360-2 | | |
| Operating Conditions | | | | |

-continued

| Column No. | 48 | 50* | 57 | 54 |
|---|---|---|---|---|
| $O_2$, psig | 500 | 500 | 500 | 500 |
| $CO_2$, psig | 300 | 300 | 300 | 300 |
| NaCl, g/l | 1 | 1 | 1 | 1 |
| $Na_2SO_4$, g/l | 74 | 74 | 7.4 | 0 |
| Results | | | | |
| Av. $U_3O_8$ in leachate ppm. | 113 | 115 | — | 57 |
| $U_3O_8$ leach rate, %/pv. | 2.6 | 2.6 | — | 1.3 |

*Preleached with $CO_2/H_2O$.

The foregoing description of my invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is my intention in the following claims to cover all such equivalent modifications and variations as fall within the true scope and spirit of my invention.

What is claimed is:

1. In the process for in situ leaching of mineral values from a mineral-bearing subterranean formation comprising pumping a suitable oxidant-containing lixiviant under pressure into the formation through one or more injection wells, allowing the lixiviant to leach out the mineral values in the formation, and removing from said formation the lixiviant pregnant with the mineral values through one or more production wells spaced from said injection wells, the improvement comprising:

(a) prior to injecting the lixiviant into the formation, pumping gaseous air or $O_2$ into the formation until said air or $O_2$ gas has broken through at the production wells, and (b) shutting in the production wells to permit oxidation of the formation.

2. The process of claim 1 further comprising repeating steps (a) and (b), if necessary, until substantially complete oxidation of the formation is achieved.

3. The process of claim 2 wherein the distribution of said air or $O_2$ gas in the formation is facilitated by alternately pumping slugs of water and air or $O_2$ gas into said formation.

4. The process of claim 2 wherein the mineral value is uranium and the lixiviant contains $CO_2/O_2$.

5. The process of claim 4 wherein the air or $O_2$ gas pumped into the formation additionally contains $CO_2$ gas such that the molar ratio of $CO_2$:$O_2$, based on the total $CO_2$ and $O_2$ content of the gas pumped into the formation, is from about 0.001:1 to 100.1.

6. The process of claim 1, 2, 3 or 4 wherein the air or $O_2$ pumped into the formation additionally contains $CO_2$ gas.

7. In the process for in situ leaching of mineral values from a mineral-bearing subterranean formation comprising pumping a suitable lixiviant under pressure into the formation through one or more injection wells, allowing the lixiviant to leach out the mineral values in the formation, and removing from said formation the lixiviant pregnant with the mineral values through one or more production wells spaced from said injection wells, the improvement comprising:

(a) after the leaching rate of said process has declined to a predetermined level, stopping the pumping of the lixiviant into the formation, (b) pumping into the formation a mixture of $CO_2$ gas and air or $O_2$ gas, wherein the molar ratio of $CO_2$:$O_2$, based on the total $CO_2$ and $O_2$ content of the mixture, is from about 0.001:1 to 100:1, and continuing said pumping until the mixture has broken through at the production wells, (c) shutting in the production wells for a time sufficient to permit reaction of the mixture with the formation, and (d) resuming the pumping of lixiviant into the formation.

8. The process of claim 7 wherein the mineral value is uranium and the lixiviant contains $CO_2/O_2$.

9. The process of claim 4, 5 or 8 wherein the lixiviant is at a pH of about 5 to 9 and contains sulfate ion in an amount of about 0.1–20% by weight.

10. In the process for in situ leaching of mineral values from a mineral-bearing subterranean formation comprising pumping an oxidant-containing lixiviant under pressure into the formation through one or more injection wells, allowing the lixiviant to leach out the mineral values in the formation, and removing from said formation the lixiviant pregnant with the mineral values through one or more production wells spaced from said injection wells, the improvement comprising:

(a) prior to injecting the lixiviant into the formation, pumping oxidant into the formation until said oxidant has broken through at the production wells, and (b) shutting in the production wells to permit oxidation of the formation.

11. The process of claim 10 further comprising repeating steps (a) and (b), if necessary, until substantially complete oxidation of the formation is achieved.

* * * * *